United States Patent [19]

Koppelman

[11] 4,052,168

[45] Oct. 4, 1977

[54] PROCESS FOR UPGRADING LIGNITIC-TYPE COAL AS A FUEL

[76] Inventor: Edward Koppelman, 4424 Bergamo Drive, Encino, Calif. 91316

[21] Appl. No.: 648,170

[22] Filed: Jan. 12, 1976

[51] Int. Cl.[2] ..... C10L 9/00; C10L 9/10

[52] U.S. Cl. ..... 44/1 G; 44/1 R; 44/6

[58] Field of Search ..... 44/1 R, 1 G, 6

[56] References Cited

U.S. PATENT DOCUMENTS

| | | | |
|---|---|---|---|
| 1,594,994 | 8/1926 | Bone | 44/1 R |
| 1,871,862 | 8/1932 | Schoch | 44/1 R |
| 2,966,400 | 12/1960 | Lykken | 44/1 G |
| 3,733,183 | 5/1973 | Singh | 44/1 R |

FOREIGN PATENT DOCUMENTS

| | | | |
|---|---|---|---|
| 32,607 | 6/1970 | Australia | 44/1 G |

OTHER PUBLICATIONS

Evans et al., "Dewatering of Brown Coal Before Combustion," Journal of the Institute of Fuel, Oct, 1970, pp. 413–419.

*Primary Examiner*—Carl F. Dees
*Attorney, Agent, or Firm*—Harness, Dickey & Pierce

[57] ABSTRACT

A process for upgrading lignitic-type coal including brown coals, lignite and subbituminous coals to render it more suitable as a solid fuel in which the moist lignitic-type coal in an as-mined condition is subjected to an autoclaving treatment at a controlled elevated temperature and under high pressure for a period of time to convert the moisture and a portion of the volatile organic constituents therein to a gaseous phase and to effect a controlled thermal restructuring of the chemical structure thereof. In accordance with a preferred practice, the autoclaved upgraded carbonaceous product during or after cooling is contacted with the gaseous phase to effect a deposition of at least a portion of the condensible organic constituents thereon. The upgraded carbonaceous product is stable and resistant to weathering, and is of an increased heating value approaching that of bituminous coal.

15 Claims, No Drawings

PROCESS FOR UPGRADING LIGNITIC-TYPE COAL AS A FUEL

BACKGROUND OF THE INVENTION

The term "lignitic-type coal" as herein employed and as set forth in the subjoined claims, broadly encompasses a series of relatively low rank or low grade carbonaceous materials or coals including lignitic coals which encompasses lignite and brown coal, as well as subbituminous coals conventionally classified as rank A, B and C in order of their heating values. Lignitic coal comprises a carbonaceous low-grade coal which has not undergone a sufficient geological metamorphosis to convert it into a high-grade hard coal such as bituminous or anthracite. Lignitic coal broadly encompasses a range of such carbonaceous materials extending somewhere between peat and subbituminous coal, with brown coal being a form of lignite which is rather closely related to peat. Technically, lignite has been classified as those carbonaceous materials found in deposits similar to coal in which the carbon-hydrogen ratio varies from about 11.2:1 to 9.3:1. Subbituminous coals are of a higher degree of carbonification than lignitic coals and are ranked in accordance with a classification system as set out in United States Bureau of Mines, Bulletin No. 492, 1951, "Methods of Analyzing Coal and Coke", as Rank A having a moist heating value of 11,000 BTU or more, but less than 13,000 BTU; Rank B having a moist heating value of 9,500 BTU or more, but less than 11,000 BTU; and Rank C having a moist heating value of 8,300 BTU or more, but less than 9,500 BTU.

In the United States, vast deposits of lignitic coal are located in the north central states, principally in North and South Dakota and Wyoming, and to a lesser extent, in southern states, including Texas, while subbituminous coals are principally found in Washington, Wyoming and Colorado. These vast deposits represent a potential solution to the present energy crisis and fuel shortage. Unfortunately, lignitic-type coal as-mined, usually contains from about 20% up to about 40% moisture, of which at least a portion must first be removed to render it suitable as a fuel. A partial or complete drying of the moist lignitic-type coal results in a disintegration thereof into fine-sized particles and dust, posing not only problems due to spontaneous combustion, but also increasing the difficulty in handling it during shipment and firing into a furnace. The disintegration of the fuel when charged into furnaces causes portions thereof to fall through the furnace grates, as well as effecting a clogging thereof, detracting from the efficiency of the combustion operation and a substantial waste of the potential heating value thereof.

A variety of processes have heretofore been used or proposed for treating lignitic-type coal so as to render it more suitable as a solid fuel. Such prior art processes generally involve a partial drying of the lignitic-type coal in an as-mined condition to reduce its moisture content, and thereafter briquetting or agglomerating the material to render it more resistant to weathering and disintegration during shipment, storage and ultimate use. Typical of prior art processes for treating lignitic-type coals are those disclosed in U.S. Pat. Nos. 838,281; 1,205,007; 1,219,155; 1,386,472; 1,477,642; 1,508,617; 1,556,036; 1,577,902; 1,600,065; 1,698,345; 1,860,890; 1,871,862; 2,627,497; 2,903,400 and 3,723,079. The large investment in briquetting equipment, the large amount of labor required in the briquetting operation and the relatively high cost of the binding and/or coating agents employed has detracted from a more widespread commercial use of such processes and has impeded the utilization of the vast domestic deposits of lignitic-type coal to ease the present energy crisis.

The process of the present invention overcomes many of the problems and disadvantages associated with prior art techniques in which lignitic-type coals are upgraded in their physical structure and heating value, rendering them stable and resistant to disintegration during weathering, handling, storage and shipment, and suitable for use as a solid fuel alone or in admixture with high-grade coals, such as bituminous coal.

SUMMARY OF THE INVENTION

The benefits and advantages of the present invention are achieved by a process in which lignitic-type coals in a substantially as-mined condition containing from about 20% up to about 40% moisture are charged into an autoclave and heated to an elevated temperature of at least about 750° F and a pressure of at least about 1,000 psi for a controlled period of time to effect a controlled thermal restructuring of the chemical structure thereof and to effect a conversion of the moisture and a portion of the volatile organic constituents therein into a gaseous phase. At the conclusion of the autoclaving step, the lignitic-type coal is cooled, preferably in contact with the gaseous phase so as to effect a deposition of the condensible organic constituent on the surfaces thereof to provide for a further stabilization of the upgraded coal product, rendering it nonhydroscopic and more resistant to weathering and oxidation during shipment and storage. The noncondensible gaseous phase is recovered and can be advantageously employed as a fuel in the process for heating the autoclave or for commercial sale.

The upgraded coal product produced is generally of a hard black glossy appearance, having an internal structure which visibly has been transformed from the original lignitic-type coal charge and which is possessed of increased heating values of a magnitude generally ranging from about 12,000 up to about 13,500 BTU per pound. In contrast, consolidated lignitic coal on an asmined basis has a heating value of about 7,000 BTU per pound, while on a moisture-free basis, has a heating value ranging from about 10,300 up to about 11,900 BTU per pound.

Additional benefits and advantages of the present invention will become apparent upon a reading of the description of the preferred embodiments taken in conjunction with the specific examples provided.

DESCRIPTION OF THE PREFERRED EMBODIMENTS

The process of the present invention is applicable for upgrading lignitic-type coals in accordance with the definition as hereinbefore set forth including brown coal, lignite and subbituminous coals of the type broadly ranging between peat and bituminous coals which are found in deposits similar to higher grade coals. Such lignitic-type coals as-mined generally contain from about 20% up to about 40% moisture and can be directly employed without any preliminary treatment other than a screening operation as a charge to the autoclave. It is usually preferred to effect a screening and/or crushing of the lignitic-type coal as-mined to remove any large agglomerates so as to facilitate a handling of the charge and to improve the packing characteristics thereof in the autoclave. The size and configuration of the lignitic-type coal particles, however, are not critical in achieving the benefits of the process of the present invention.

Some reduction in the moisture content of the lignitic-type coal may occur as a result of weathering during storage prior to charging to the autoclave. It is also contemplated that the lignitic-type coal can be washed and excess moisture removed prior to autoclaving. Ordinarily, the lignitic-type coal charged to the autoclave is substantially in an as-mined moist condition.

The autoclave employed may comprise any of the types known in the art capable of withstanding the temperatures and pressures required, and while the present description is directed particulary to batch-type autoclaves, it will be understood that continuous autoclaves can also be employed for the practice of the present process. The lignitic-type coal is charged to the autoclave, which thereafter is sealed and is heated to an elevated temperature of at least about 750° F and to a pressure greater than 1,000 psi, and preferably greater than about 2,000 psi, for a period of time to effect a vaporization of the moisture content and a volatilization of some of the organic constituents in the lignitic-type coal forming a gaseous phase. A controlled degree of thermal restructuring and/or decomposition of the chemical structure also occurs accompanied by the generation of additional gaseous components which also enter the gaseous phase. It has been observed that at the elevated temperature and pressure conditions employed, a gas-shift reaction occurs between the water molecules and the gaseous hydrocarbons and/or solid lignitic-type coal material, forming additional hydrocarbon gases which possess utility as a fuel.

While temperatures of at least about 750° F are desirable during the autoclaving operation, temperatures of about 1000° F are preferred due to the increased rate of volatilization and thermal restructuring to a higher fixed carbon value, thereby providing for reduced residence times in the autoclave and improved efficiency of operation. The temperature of the autoclaving operation may range up to as high as about 1250° F, and temperatures above this level are usually undesirable because of too high a ratio of noncondensible gases to solid upgraded product. Particularly satisfactory results have been obtained employing temperatures ranging from about 1000° to about 1200° F at pressures ranging from about 2,000 psi to about 3,000 psi. The maximum pressure useable may be as high as about 3,300 psi. Pressures generally above about 3,300 psi are undesirable due to the increased fabrication costs of pressure vessels capable of withstanding pressures of this magnitude and the absence of any appreciable benefits at such elevated pressures beyond those obtained at lower pressure levels of about 3,000 psi.

The residence time of the lignitic-type coal charge in the autoclave will vary depending upon the specific temperature-pressure-time relationship which is controlled within the parameters as hereinabove set forth to effect a substantially complete vaporization of the moisture content and volatile organic constituents and a controlled thermal restructuring of the lignitic-type coal.

The thermal restructuring is not completely understood but is believed to consist of two or more simultaneous chemical reactions occurring between the pyrolysis products and the gases present within the cellular structure of the lignitic-type material. The net effect of these restructuring reactions are: (1) changes in the physical characteristics resulting in particles that are more resistant to moisture adsorption and decrepitation, and (2) changes in the chemical characteristics resulting in an increase in the carbon-hydrogen ratio and a decrease in the sulfur and oxygen content as measured by the ultimate analysis of the coal.

The required residence time decreases as the temperature and pressure in the autoclave increases; while conversely, increased residence times are required when temperatures and pressures of lower magnitude are employed. Usually, residence times ranging from about 15 minutes up to about one hour at temperatures ranging from about 900° to about 1200° F under pressures of from about 2,000 psi to about 3,000 psi are satisfactory.

The pressurization of the interior of the autoclave can be conveniently accomplished by controlling the quantity of lignitic-type coal charged relative to the interior volume of the autoclave in consideration of the moisture content of the charge, such that upon heating thereof to the elevated temperature, the formation of the gaseous phase comprised of superheated steam and volatile organic matter effects a pressurization of the autoclave within the desired pressure range. Supplemental pressurization of the autoclave can be achieved, if desired, by introducing pressurized nonoxidizing or reducing gases into the autoclave.

At the conclusion of the autoclaving step, in accordance with one embodiment of the present invention, the autoclave is permitted to cool, either by air cooling or by the use of a cooling fluid, such as cooling water, to a temperature below that at which the autoclaved upgraded carbonaceous product can be exposed to air without adverse effects. Ordinarily, the cooling of the autoclave to temperatures below about 300° F is adequate. A cooling of the autoclave to temperatures approaching 212° F or below is generally undesirable because the condensation of the gaseous water phase which wets the upgraded carbonaceous product increasing its moisture content and correspondingly lowering its heating value. During the cooling operation, the volatilized organic constitutents, including relatively heavy hydrocarbon fractions and tars, are first to condense during the gradual cooling cycle and deposit on the surfaces and within the pores of the lignitic-type coal structure, effecting a coating thereof which is advantageous in rendering the upgraded carbonaceous product more resistant to weathering and disintegration and to the adsorption of moisture upon being exposed to humid ambient atmospheres. Upon attaining the desired cooled temperature, the residual gaseous phase is released from the autoclave and is recovered as a suitable by-product fuel gas for use in the process or for commerical sale.

The upgraded carbonaceous product is generally of a black glossy appearance, further evidencing an internal thermal transformation from the original dull lignitic-type coal structure of the feed material. The residual moisture content is the upgraded carbonaceous product will generally range from about 1% up to about 5% by weight.

It is also contemplated in accordance with an alternative embodiment of the present process that at the completion of the autoclaving operation, the high pressure within the autoclave can be released at the autoclaving operating temperature and the hydrocarbon constituents recovered by condensation and the organic noncondensible gaseous constituents recovered as a by-product fuel gas. In this latter situation, only a small degree of deposition of the volatilized organic constituents is effected on the upgraded carbonaceous product. The carbonaceous product thus produced is nevertheless characterized as having a thermally transformed structure which is of improved heating value and resistance to weathering and disintegration.

It is also contemplated that a two-stage autoclaving and recoating operation can be performed wherein the gaseous phase released from the autoclave while still at temperature is transferred to a second cooling chamber in which an upgraded carbonaceous product from a prior autoclaving step has been transferred for cooling and the gaseous phase is introduced in contact with the cooled charge. Ordinarily, the cooled charge is permitted to cool to temperatures of less than about 500° F, and usually to temperatures of about 300° F or slightly lower. The hot gaseous phase upon coming in contact with the cooled charge effects a condensation of the condensible organic constituents therein, which as before, effects a coating and impregnation of the upgraded carbonaceous product. The residual uncondensed gaseous phase is recovered as a by-product fuel gas. The cooling of the upgraded charge is performed under nonoxidizing conditions and may conveniently be achieved by a direct transfer of the charge from the autoclave to a sealed cooling chamber disposed in communication therewith through a suitable valve arrangement.

In order to further illustrate the process of the present invention, the following specific examples are provided. It will be understood that the examples are provided as being illustrative of useable variations in the time, temperature and pressure relationships employed in the process and are not intended to be limiting of the scope of the invention as herein described and as set forth in the subjoined claims.

EXAMPLE 1

A lignitic coal derived from a mine in Zap, North Dakota, having an average moisture content of about 30% by weight and being of a slate color, is screened to provide a particulated charge of a particle size less than ½ inch. A measured amount comprising 6.64 grams is placed in a stainless steel pressure vessel having an internal chamber three inches long and of a circular cross sectional configuration of ⅛ inch diameter and a wall thickness of about ¼ inch. The ends are capped with screw-type couplings to seal the charge within the chamber. The pressure vessel or autoclave is placed in a furnace chamber heated to 1000° F and after a 5 minute preheating period, is maintained at temperature for a residence time of 30 minutes. At the completion of the autoclaving operation, the pressure vessel is removed and cooled under tap water to room temperature, wherefter an end cap is removed to release the residual pressure and the charge is removed and subjected to a moderate drying operation to remove surface water by air drying. The upgraded lignite product weighs 4.98 grams, evidencing a loss of 25% and has an average heating value of 12,549 BTU per pound. The upgraded carbonaceous product is of a dark color and is of a glossy appearance.

EXAMPLE 2

The procedure as described in Example 1 is repeated employing a lignitic coal charge of 4.81 grams, which is heated for a total time period of 60 minutes to a temperature of 750° F. At the conclusion of the autoclaving step, the pressure vessel is removed and permitted to air cool to room temperature, whereafter the cap is removed to release the residual gas pressure and the resultant product has a heating value of 11,333 BTU per pound. The upgraded carbonaceous product recovered weighs 3.5 grams, evidencing a loss of 27.3% by weight.

EXAMPLE 3

The test procedure as described in Example 1 is repeated employing a lignitic charge of 5.91 grams, which is heated for a total duration of sixty minutes in a furnace at a temperature of 875° F. The resultant pressure vessel is cooled under tap water to room temperature and is opened to release the residual gas pressure. An upgraded carbonaceous product weighing 4.1 grams is recovered, evidencing a loss of about 30%, which has a heating value of 11,745 BTU per pound.

EXAMPLE 4

The test procedure of Example 1 is repeated employing a lignitic charge weighing 5.1 grams which, after a five-minute preheat period, is maintained at a temperature of 750° F for a period of 30 minutes. At the completion of the autoclaving step, the pressure vessel is removed and force cooled by tap water to room temperature and the end cap is removed to release the residual gas pressure. A total 4.52 grams of upgraded product is recovered, representing a loss of 11.3% by weight and the product has a heating value of 9,937 BTU per pound.

EXAMPLE 5

The test procedure as described in Example 1 is repeated employing a lignitic charge of b 5.67 grams which is heated for a total period of 60 minutes in a furnace maintained at 1000° F, whereafter it is cooled by tap water to room temperature and an end cap is removed to release the residual gas pressure. A total of 3.58 grams of upgraded product is recovered, representing a loss of 36.8% by weight, which has a BTU value of 12,774 BTU per pound.

EXAMPLE 6

The test procedure as described in Example 1 is repeated employing a lignitic charge of 5.58 grams which, after a five-minute preheat period, is maintained at 1000° F for a period of 30 minutes, whereafter the pressure vessel is removed and force cooled by tap water to room temperature. An end cap is removed to release the residual gas pressure and the upgraded carbonaceous product comprising 3.39 grams is recovered. The product represents a loss of 39% by weight of the charge and has a measured heating value of 12,020 BTU per pound.

EXAMPLE 7

The test procedure as described in Example 1 is repeated employing a lignitic charge of 5.67 grams which, after a five-minute preheat period, is maintained at a temperature of 1000° F for a period of 30 minutes. The resultant pressure vessel is removed and force cooled by tap water to room temperature, whereafter an end cap is removed to release the residual gas pressure and an upgraded lignite product comprising 3.71 grams is recovered. This represents a loss of 34.5% by weight of the charge material, and the product has a measured heating value of 12,633 BTU per pound.

EXAMPLE 8

The test procedure as described in Example 1 is repeated employing a lignitic charge of 5.23 grams which after a preliminary preheat of 5 minutes, is maintained at 1000° F for a period of 30 minutes. The hot pressure vessel is removed, and while still at substantially 1000° F, an end cap is removed to release the internal gas pressure. The resultant upgraded carbonaceous product comprises 2.9 grams, representing a loss of 44% of the charge. The product has a heating value of 11,816 BTU per pound.

EXAMPLE 9

The test procedure as described in Example 1 is repeated but the lignitic charge material is first subjected to a preliminary air drying operation in a manner to reduce the moisture content therein to about 14%. The filled and sealed pressure vessel, after a five-minute preheat period, is maintained at 1000° F for a period of 30 minutes, whereafter it is force cooled by tap water to about room temperature. Of the 5.75 grams charge material, 4.2 grams of upgraded carbonaceous product is obtained, representing a loss of about 27%. The product has a measured heating value of 11,332 BTU per pound.

EXAMPLE 10

The procedure as described in Example 9 is repeated employing a predried lignite charge containing approximately 14% moisture comprising a total of 5.97 grams, which, after heating for 30 minutes at 1000° F following a five-minute preheat period, is removed and permitted to air cool. When the pressure vessel attains a temperature of about 350° F, an end cap is removed to release the residual gas pressure. A product comprising 4.1 grams is recovered, representing a loss of 31% by weight of the charge. The upgraded carbonaceous product has a heating value of 12,397 BTU per pound.

EXAMPLE 11

The test procedure as described in Example 1 is repeated employing a lignitic charge material containing about 30% moisture, which, after a five-minute preheat period, is maintained at 1000° F for a period of 30 minutes. A total of 5.64 grams of charge material is employed and at the completion of the autoclaving step, the pressure vessel is removed and permitted to air cool as in the case of Example 10 to a temperature of about 350° F, whereafter an end cap is removed to release the residual gas. An upgraded carbonaceous product comprising 3.33 grams is recovered, representing a loss of about 40% and has a measured heating value of 12,978 BTU per pound.

EXAMPLE 12

A test procedure as described in Example 1 is repeated employing 5.4 grams of a lignitic charge which, after a five-minute preheat period, is maintained at 1000° F for a period of 15 minutes. The pressure vessel is removed and permitted to cool in air to about 350° F, whereafter an end cap is removed to release the residual gas pressure. An upgraded carbonaceous product, comprising 3.52 grams, is recovered, representing a loss of 34.8%, which has a heating value of 12,527 BTU per pound.

In all of the examples as hreinabove described, with the exception of Examples 9 and 10, the pressure within the autoclave or pressure vessel during the autoclaving step is calculated to range from about 2,000 to about 2,700 psi. In Examples 9 and 10, employing a partially dried feed material, the calculated pressure during the autoclaving step ranges from about 1,000 to about 1,400 psi. The time, temperature and pressure relationships employed in Examples 1-12 evidence an effect on the heating value expressed in terms of BTU per pound of the upgraded carbonaceous product as a function of these variables, which also to some extent can be correlated to the loss in weight of the product recovered relative to the initial charge. These data clearly evidence the interrelationship of time, temperature and pressure in effecting a thermal restructuring of the charge material and a release of the moisture content and volatile organic constituents therein so as to provide an upgraded solid fuel product having heating values approaching that of bituminous coal.

The upgraded carbonaceous products derived from the tests described in Examples 1-12 are also subjected to a humidity test to determine the hygroscopic nature thereof, which is indicative of their resistance to weathering upon exposure for prolonged time periods to ambient atmospheric conditions. In each instance when the charge is force cooled, the upgraded carbonaceous product is air dried in the presence of heated air to remove residual surface water, is weighed and thereafter placed in a humidity chamber maintained at a temperature ranging from 25° to about 30° C, and at a relative humidity of about 90%. The results of some of these humidity tests listing the duration time in the humidity chamber and the percent gain or loss in weight is set out in Table 1.

TABLE 1

| Humidity Test Results | | |
|---|---|---|
| Example | Total Time, Hours, | Percent Gain/Loss in Weight |
| 1 | 262 | 0 |
| 3 | 221 | −4% |
| 8 | 221 | +3% |
| 9 | 77 | +1% |
| 12 | 42 | +0.3% |

It is apparent from the test data as set out in Table 1 that the upgraded carbonaceous product is not only upgraded in terms of its average heating value, but also is relatively stable and nonhygroscopic, evidencing a high degree of resistance to the adsorption of moisture in spite of relatively low moisture contents of a magnitude generally ranging from about 1% to about 5% of the upgraded product.

EXAMPLE 13

The test procedure as described in Example 11 is repeated employing a charge of 6.71 grams Colstrip subbituminous coal, which is heated for a total duration of thirty minutes at 1000° F after being brought up to temperature in 5 minutes. At the conclusion of the autoclaving step, the vessel is permitted to cool to 300° F, whereupon the cap is unscrewed and the residual pressure released. A product comprising 3.99 grams is recovered, representing a loss of 40.9% by weight of charge. The upgraded coal product has a heating value of 12,927 BTU per pound. This product is compared to a control sample of untreated Colstrip subbituminous coal in both as-received and moisture-free form, and the comparative data as set out in Table 2 illustrate the increase in heating value and the decrease in sulfur and oxygen content caused by the autoclaving treatment.

TABLE 2

| Comparative Data Subbituminous Coal from Colstrip, Montana | Control Sample | | Treated Sample | |
|---|---|---|---|---|
| | As Received | Moisture Free | As Received | Moisture Free |
| Moisture (wt %) | 16.8 | 0 | 1.9 | 0 |
| Heating Value (BTU/lb) | 9639 | 11585 | 12927 | 13177 |
| Ultimate Analysis | | | | |
| C | 56.3 | 67.7 | 77.2 | 78.7 |
| H | 2.90 | 3.49 | 2.95 | 3.01 |
| S | 1.30 | 1.56 | 1.38 | 1.41 |
| N | 0.78 | 0.94 | 1.06 | 1.08 |
| O | 28.9 | 14.5 | 5.3 | 3.5 |
| Ash | 9.78 | 11.8 | 12.1 | 12.3 |

Although the data in Table 2 illustrate the improved qualities of the treated coal over the original coal, it does not emphasize the reduction in sulfur that has occurred. This can be shown by allowing a sulfur balance through the treatment. One hundred pounds of as-received subbituminous coal contains 1.30 pounds of sulfur. This is converted to 59.1 pounds of upgraded product containing 1.38 weight percent sulfur, or 0.82 pounds of sulfur. This shows that 0.48 pounds, or 37 weight percent, of the sulfur in 100 pounds of as-received coal is removed in the treatment.

EXAMPLE 14

The test procedure as described in Example 11 is repeated employing a charge of 5.90 grams lignite from Buleah, North Dakota, which is heated for a total duration of 30 minutes at 1000° F after being brought up to temperature in 10 minutes. At the conclusion of the autoclaving step, the vessel is permitted to cool to 300° F, whereupon the cap is unscrewed and the residual pressure released. A product comprising 3.25 grams of treated lignite is recovered representing a loss of 44.9% by weight of charge. The upgraded lignite product has a heating value of 13,048 BTU per pound. This product is compared to a control sample of untreated Buleah lignite, in both as-received and moisture-free form, in Table 3 to illustrate the improved ultimate analysis.

TABLE 3

| Comparative Data Lignite from Buleah, North Dakota | Control Sample | | Treated Sample | |
|---|---|---|---|---|
| | As Received | Moisture Free | As Received | Moisture Free |
| Moisture (wt %) | 24.25 | 0 | 2.85 | 0 |
| Heating Value (BTU/lb) | 8427 | 11125 | 13048 | 13430 |
| Ultimate Analysis | | | | |
| C | 49.7 | 65.6 | 76.5 | 78.7 |
| H | 2.76 | 3.64 | 3.14 | 3.23 |
| S | 1.21 | 1.6 | 0.77 | 0.79 |
| N | 0.58 | 0.77 | | |
| O | 34.8 | 19.3 | 10.6* | 8.6* |
| Ash | 6.91 | 9.12 | 9.03 | 9.27 |

*0 + N reported as O

While it will be apparent that the invention herein described is well calculated to achieve the benefits and advantages as hereinabove set forth, it will be appreciated that the invention is susceptible to modification, variation and change without departing from the spirit thereof.

What is claimed is:

1. A process for upgrading lignitic-type coals which comprises the steps of charging a moist lignitic-type coal into an autoclave, heating said lignitic-type coal to an elevated temperature of at least about 750° F up to about 1250° F and under a pressure of at least about 1000 psi for a period of time sufficient to convert the moisture and some of the volatile organic constituents therein into a gaseous phase and to effect a partial thermal restructuring of the chemical structure thereof and a change in its chemical composition, and thereafter cooling the lignitic-type coal charge and recovering the upgraded coal product.

2. The process as defined in claim 1, including the further step of contacting the lignitic-type coal charge with said gaseous phase during the cooling step to effect a deposition of the condensible organic constituents therein on the surface of said upgraded coal product.

3. The process as defined in claim 1, wherein the step of heating said lignitic-type coal is conducted at a temperature of at least about 900° up to about 1250° F.

4. The process as defined in claim 1, wherein the step of heating said lignitic-type coal is conducted at a temperature of at least about 1000° up to about 1200° F.

5. The process as defined in claim 1, wherein the step of heating said lignitic-type coal is carried out at an elevated pressure of at least about 1,000 psi up to about 3,300 psi.

6. The process as defined in claim 1, wherein the step of heating said lignitic-type coal to an elevated temperature is conducted at a pressure of at least about 2,000 psi up to about 3,000 psi.

7. The process as defined in claim 1, wherein the step of heating said lignitic-type coal to an elevated temperature and pressure is conducted for a period of time of at least about 15 minutes.

8. The process as defined in claim 1, wherein the step of heating said lignitic-type coal to an elevated temperature and pressure is conducted for a period of time of at least about 30 minutes.

9. The process as defined in claim 1, wherein the steps of heating and cooling said lignitic-type coal are performed in said autoclave which is retained in substantially sealed condition whereby the upgraded coal product is retained in contact with said gaseous phase to effect a deposition of at least a portion of the condensible organic constituents therein on the surfaces of said upgraded coal product.

10. The process as defined in claim 1, including the further step of releasing the pressure in said autoclave at the completion of said period of time and withdrawing the gaseous phase therein, transferring the heated said lignitic-type coal charge to a cooling chamber provided with a substantially nonoxidizing atmosphere, cooling the transferred said lignitic-type coal charge to a reduced temperature and thereafter contacting the cooled said lignitic-type coal charge with said gaseous phase withdrawn from said autoclave.

11. The process as defined in claim 1, including the further step of controlling the quantity of lignitic-type coal charged into said autoclave relative to the interior volume of said autoclave such that upon heating thereof to said elevated temperature said gaseous phase effects a pressurization of the interior of said autoclave to the desired elevated pressure.

12. The process as defined in claim 1, in which the step of heating said lignitic-type coal to an elevated temperature and pressure is performed in a manner to reduce the oxygen content of the upgraded coal product as a result of the partial thermal restructuring of the chemical structure thereof and a change in its chemical composition.

13. The process as defined in claim 1, in which the step of heating said lignitic-type coal to an elevated temperature and pressure for a period of time is performed in a manner to effect a reduction in the sulfur content of said upgraded coal product.

14. The process as defined in claim 1, in which the step of heating said lignitic-type coal to an elevated temperature and pressure for a period of time is performed such that the upgraded coal product on a moisture-free basis has a heating value greater than the heating value of the original lignitic-type coal charged into the autoclave on a moisture-free basis.

15. An upgraded coal product produced in accordance with the process as defined in claim 1.

* * * * *

UNITED STATES PATENT AND TRADEMARK OFFICE

CERTIFICATE OF CORRECTION

PATENT NO. : 4,052,168

DATED : October 4, 1977

INVENTOR(S) : Edward Koppelman

It is certified that error appears in the above-identified patent and that said Letters Patent are hereby corrected as shown below:

Column 3, line 62 after "content and" insert --volatilization of some of the --; Column 4, line 60 "is" should be -- in --; Column 5, line 48 "1/8" should be -- 5/8 --; line 57 "wherefter" should be -- whereafter --; Column 6, line 36 after "of" delete -- b --; Column 7, line 67 "hreinabove" should be -- hereinabove --; Column 9, line 18 "allowing" should be -- following --.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*